US010428838B2

(12) United States Patent
Song et al.

(10) Patent No.: US 10,428,838 B2
(45) Date of Patent: Oct. 1, 2019

(54) CENTRIFUGAL FAN

(71) Applicant: LG ELECTRONICS INC., Seoul (KR)

(72) Inventors: Kiwook Song, Seoul (KR); Jinsoo Kim, Seoul (KR); Dongwook Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 414 days.

(21) Appl. No.: 15/277,714

(22) Filed: Sep. 27, 2016

(65) Prior Publication Data

US 2017/0097015 A1 Apr. 6, 2017

(30) Foreign Application Priority Data

Oct. 1, 2015 (KR) ..... 10-2015-0138798

(51) Int. Cl.

| | |
|---|---|
| ***F04D 29/66*** | (2006.01) |
| ***F04D 29/28*** | (2006.01) |
| ***F04D 29/30*** | (2006.01) |
| ***F04D 17/16*** | (2006.01) |
| ***F04D 29/42*** | (2006.01) |
| ***F24F 1/0022*** | (2019.01) |

(52) U.S. Cl.

CPC ..... *F04D 29/667* (2013.01); *F04D 17/16* (2013.01); *F04D 29/282* (2013.01); *F04D 29/283* (2013.01); *F04D 29/30* (2013.01); *F04D 29/4226* (2013.01); *F05D 2250/70* (2013.01); *F24F 1/0022* (2013.01)

(58) Field of Classification Search

CPC .... F04D 29/668; F04D 29/663; F04D 29/661; F04D 29/66; F04D 29/667

USPC ..... 416/178

See application file for complete search history.

(56) References Cited

U.S. PATENT DOCUMENTS

2015/0056910 A1 2/2015 Ikeda et al.

FOREIGN PATENT DOCUMENTS

| | | | |
|---|---|---|---|
| CN | 2073501 | U | 3/1991 |
| CN | 101595309 | A | 12/2009 |
| CN | 104641123 | A | 5/2015 |
| DE | 2203284 | A1 | 8/1973 |
| EP | 2 131 041 | A1 | 12/2009 |
| EP | 2131041 | B1 * | 8/2018 |
| JP | 2007-278268 | A | 10/2007 |
| KR | 10-2006-0089789 | A | 8/2006 |

(Continued)

OTHER PUBLICATIONS

"Gibbings, J.C., Dimensional Analysis, 2011, London: Springer (Print), p. 155".*

*Primary Examiner* — Carlos A Rivera
*Assistant Examiner* — Jason Mikus
(74) *Attorney, Agent, or Firm* — Dentons US LLP

(57) ABSTRACT

A centrifugal fan includes: a housing; an impeller which is mounted in the housing; a hub which is provided in the impeller and is rotated by a driving force of a motor; and a plurality of blades which radially extend at the hub. Each of the plurality of blades is formed to have a shape curved from a leading edge to a trailing edge in a rotational direction of the impeller in each of the plurality of blades. A farthest point from a plane connecting the leading edge and the trailing edge is defined as a peak portion. The peak portion is placed closer to the leading edge than the trailing edge.

13 Claims, 6 Drawing Sheets

(56) References Cited

FOREIGN PATENT DOCUMENTS

| | | | | |
|---|---|---|---|---|
| KR | 10-2009-0086640 | A | 8/2009 | |
| WO | 01/05652 | A1 | 1/2001 | |
| WO | WO-0105652 | A1 * | 1/2001 | ..... F04D 29/282 |

* cited by examiner

| | $D_2$ (mm) | $D_2/H$ | N (rpm) | $D_1$ (mm) | Z (ea.) | OA (degree) | Chord length (mm) | $\beta_1$ (rpm) | $\beta_2$ (rpm) | POMC | MC |
|---|---|---|---|---|---|---|---|---|---|---|---|
| Max | 155.7 | 31 | 2650 | 128.8 | 60 | 9.8 | 20.65 | 104.35 | 63.85 | 0.49 | 0.16 |
| Min | 135.8 | 2.7 | 4820 | 116.4 | 50 | 5.5 | 18.12 | 90.74 | 49.95 | 0.01 | 0.05 |

CENTRIFUGAL FAN

CROSS-REFERENCE TO RELATED APPLICATIONS

The present application claims priority under 35 U.S.C. 119 and 35 U.S.C. 365 to Korean Patent Application No. 10-2015-0138798 (filed on Oct. 1, 2015), which is hereby incorporated by reference in its entirety.

BACKGROUND

The present disclosure relates to a centrifugal fan.

A centrifugal fan, which is a type of an air blower, is driven by a motor and blows air from an inside of an impeller in a circumferential direction through rotation of the impeller due to a centrifugal force. Generally, the centrifugal fan is used in a device that requires a flow rate and a pressure. As an example, the centrifugal fan is used in an air conditioner, a dryer, a hair dryer, or the like.

The centrifugal fan includes a housing, an impeller accommodated in the housing, and a motor for rotating the impeller. Outside air is introduced into the housing in an axial direction of the impeller, is compressed, and is then discharged in a rotational direction of the impeller. Discharge flow rate performance of the centrifugal fan is affected by a shape of the impeller, performance of the motor, a shape of the housing, or the like.

"CENTRIFUGAL FAN" is disclosed in Korean Patent Application Publication No. 10-2006-0089789.

SUMMARY

Embodiments provide a centrifugal fan which capable of satisfying a flow rate and pressure performance and reducing a flow noise by changing a shape of a blade provided in an impeller.

In one embodiment, a centrifugal fan includes: a housing; an impeller which is mounted in the housing; a hub which is provided in the impeller and is rotated by a driving force of a motor; and a plurality of blades which radially extend at the hub, wherein each of the plurality of blades is formed to have a shape curved from a leading edge to a trailing edge in a rotational direction of the impeller in each of the plurality of blades, a farthest point from a plane connecting the leading edge and the trailing edge is defined as a peak portion, and the peak portion is placed closer to the leading edge than the trailing edge.

The details of one or more embodiments are set forth in the accompanying drawings and the description below. Other features will be apparent from the description and drawings, and from the claims.

DETAILED DESCRIPTION OF THE EMBODIMENTS

Figure 1:
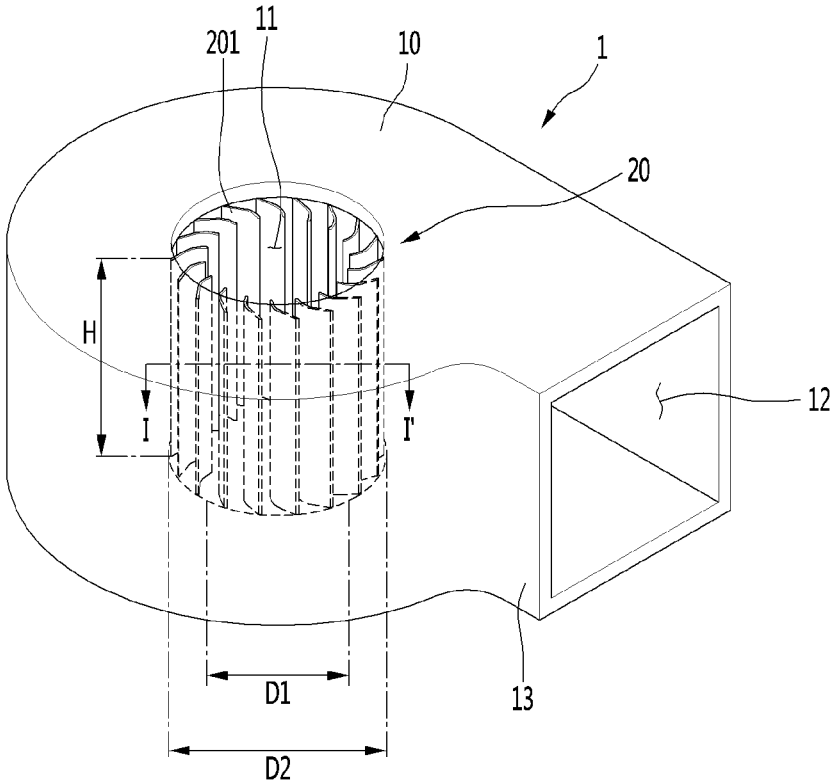
FIG. 1 is a perspective view illustrating a centrifugal fan according to an embodiment of the present disclosure.

Hereinafter, some embodiments of the present disclosure will be described in detail with reference to the exemplary drawings. In the following description, the same elements will be designated by the same reference numerals although they are shown in different drawings. Further, in the following description of embodiments of the present disclosure, a detailed description of known functions and configurations incorporated herein will be omitted when it may make the subject matter of the present disclosure rather unclear.

Additionally, in describing the components of the present disclosure, there may be terms used like first, second, A, B, (a), and (b). These are solely for the purpose of differentiating one component from the other and not to imply or suggest the substances, order or sequence of the components. If a component is described as "connected", "coupled", or "linked" to another component, they may mean the components are not only directly "connected", "coupled", or "linked" but also are indirectly "connected", "coupled", or "linked" via a third component.

FIG. 1 is a perspective view illustrating a centrifugal fan according to an embodiment of the present disclosure.

Referring to FIG. 1, a centrifugal fan 1 according to an embodiment of the present disclosure includes a housing 10, an impeller 20, and a motor (not shown). The impeller 20 may be rotatably mounted in the housing 10, and the motor may be connected to the impeller 20 to provide a rotational force to the impeller 20.

A suction port 11 through which outside air is suctioned and a discharge port 12 through which air is discharged are formed in the housing 10.

Air introduced from the outside flows toward a rotational axis of the impeller 20 through the suction port 11. The discharge port 12 may be formed in a radial direction of the impeller 20. That is, the suction port 11 and the discharge port 12 are formed perpendicular to each other.

Therefore, air introduced into the housing 10 through the suction port 11 can be discharged through the discharge port 12 in the radial direction.

A cut-off portion 13 may be formed on one side of the discharge port 12.

Air introduced through the suction port 11 flows toward the discharge port 12 along an air channel gradually expanded from the cut-off portion 13. Air discharged through the discharge port 12 is discharged to the outside of the discharge port 12 while a static pressure is recovered from a dynamic pressure around the discharge port 12.

The impeller may be provided with a hub (not shown) rotated by a driving force of the motor and a plurality of blades 201 radially extending at the hub. A flow rate and pressure performance of the centrifugal fan 1 can be affected by a shape, a placement, and the like of the plurality of blades 201.

Figure 2:
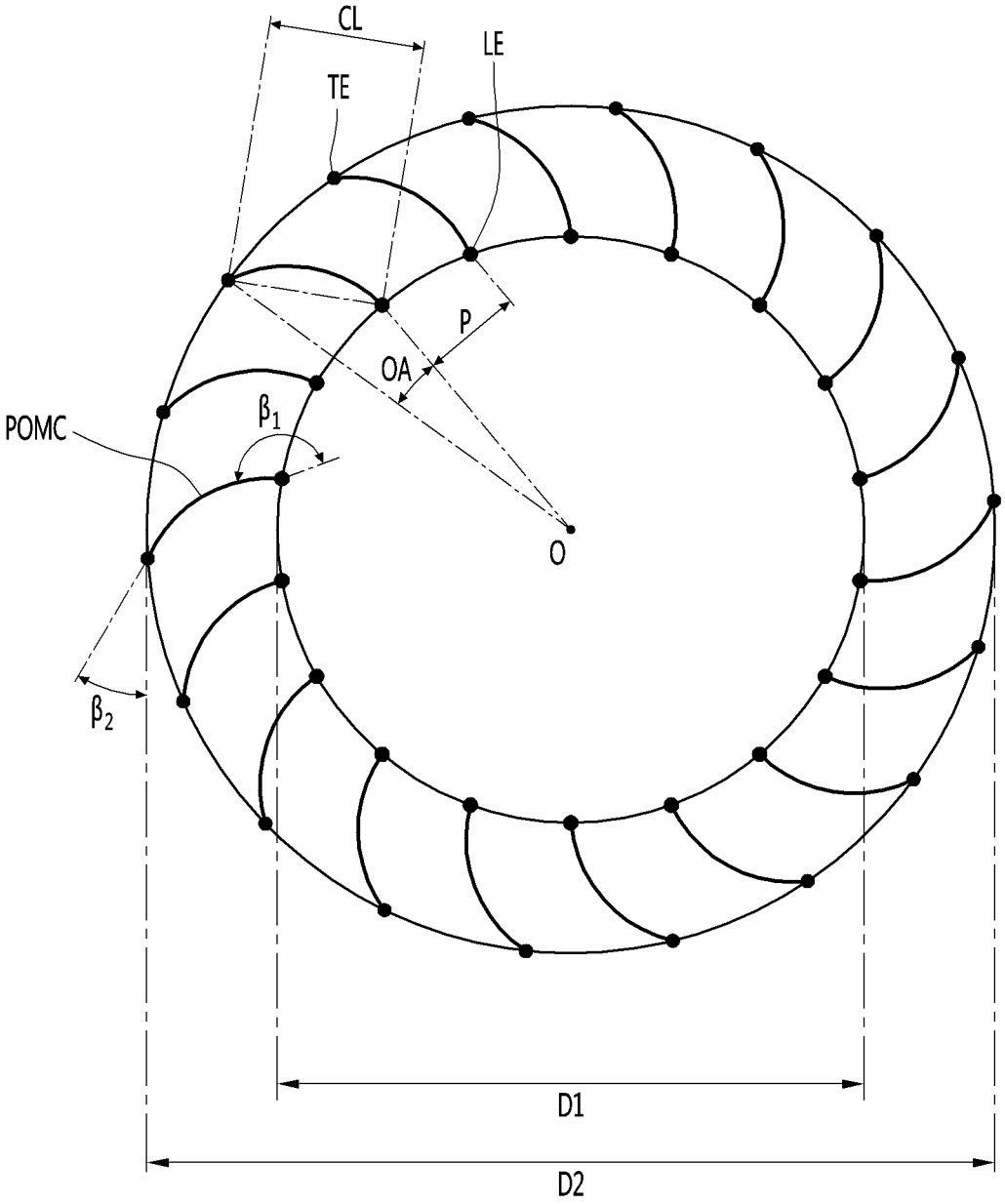
FIG. 2 is a cross-sectional view taken along line I-I' of FIG. 1.
Figure 3:
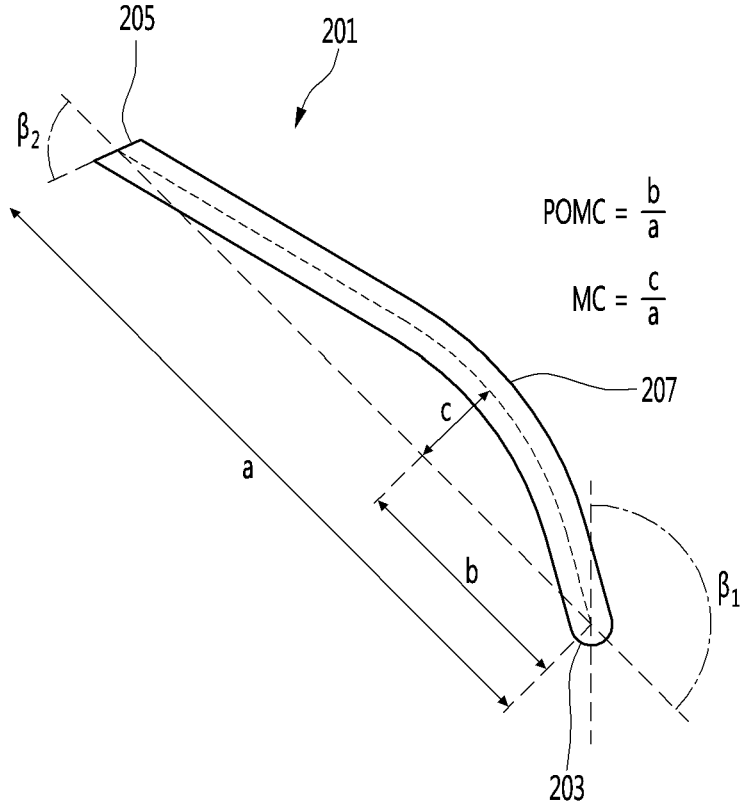
FIG. 3 is a view illustrating a blade of FIG. 2.

FIG. 2 is a cross-sectional view taken along line I-I' of FIG. 1, and FIG. 3 is a view illustrating a blade of FIG. 2.

Referring to FIGS. 2 and 3, each of a plurality of blades 201 is formed to have a curved shape. An inner edge of each of the blades 201 is referred to as a leading edge (LE) 203, and an outer edge thereof is referred to as a trailing edge (TE) 205.

Each of the blades 201 is formed to have a shape curved from the leading edge 203 to the trailing edge 205 in a rotational direction of the impeller 20.

In the blades 201, the farthest point from a plane connecting the leading edge 203 and the trailing edge 205 can be defined as a peak portion 207.

A distance from the plane to the peak portion 207 can be referred to as a bending height.

The peak portion 207 may be placed closer to the leading edge 203 than the trailing edge 205. That is, the peak portion 207 is placed at a position biased toward a rotational axis O of the impeller 20 than a central portion of each of the blades 201.

There is an effect on flow uniformity at the leading edge 203 and the trailing edge 205 of the blade 201 through such a shape. The aforementioned effect can be confirmed through a flow analysis.

Hereinafter, factors for controlling the flow rate and the pressure performance of the centrifugal fan 1 will be described.

D1 (mm) means an internal diameter of the blades 201. The internal diameter of the blades 201 means a diameter of a circle connecting leading edges 203 of the plurality of blades 201. At this time, the rotational axis O of the blades 201 becomes the center of the circle.

D2 (mm) means an external diameter of the blades 201. The external diameter of the blades 201 means a diameter of a circle connecting trailing edges 205 of the plurality of blades 201. At this time, the rotational axis O of the plurality of blades 201 becomes the center of the circle.

P (mm) is a pitch of the plurality of the blades 201 and means a distance between the plurality of blades 201.

OA (degrees) is an acronym for occupation angle and means a tilted angle of each of the blades 201. Specifically, OA means angle between the leading edge 203 and the trailing edge 205 of each of the blades 201.

CL (mm) is an acronym for chord length and means a string length of each of the blades 201. Specifically, the string length of each of the blades 201 is defined as a distance a from the leading edge 203 to the trailing edge 205.

POMC is an acronym for position of maximum camber and is defined as a ratio of a distance b from the leading edge 203 of the blade 201 to the peak portion 207 thereof to the string length a thereof.

MC is an acronym for maximum camber and is defined as a ratio of a height c of the peak portion 207 in the blade 201 to the string length a thereof.

$\beta_1$ (degrees) means an entrance angle of air introduced through the leading edge 203 of the blade 201. β2 (degrees) means an exit angle of air discharged through the trailing edge 205 of the blade 201.

Figure 4:
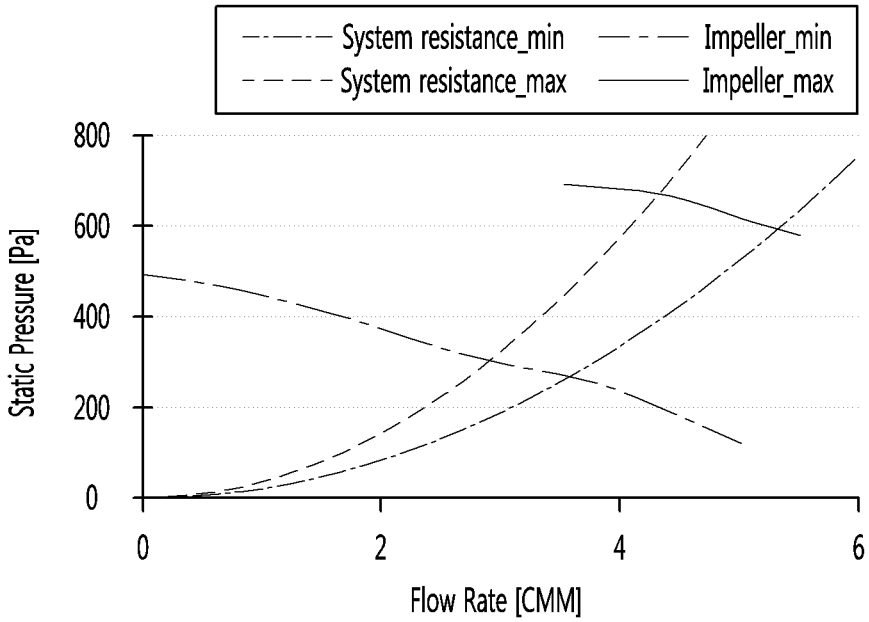
FIG. 4 is a flow rate-static pressure graph of a centrifugal fan.

FIG. 4 is a flow rate-static pressure graph of a centrifugal fan.

A graph showing a relationship between a flow rate and a static pressure of the centrifugal fan 1 according to the present disclosure is shown in FIG. 4.

The flow rate shown in the graph of FIG. 4 is an expression of a flow rate of air, which is generated by the impeller 20 according to the present disclosure, in cubic meter per minute (CMM) unit.

The static pressure shown in the graph of FIG. 4 is an expression of a pressure, which is perpendicularly applied to a fluid flowing in the blade 201 of the impeller 20 according to the present disclosure, in Pascal (Pa) unit.

System resistance_min means a minimum value of a system resistance commonly applied, and System resistance_max is a maximum value of a system resistance commonly applied.

Impeller_min means a minimum value of the impeller 20 according to the present disclosure, and Impeller_max means a maximum value of the impeller 20 according to the present disclosure.

Figure 5:
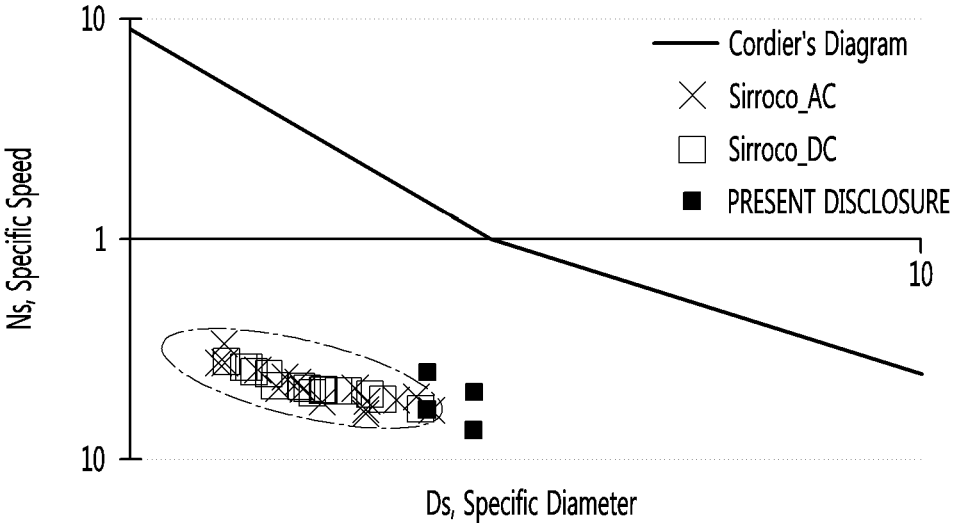
FIG. 5 is a Cordier's diagram showing a relationship between a specific diameter and a specific speed.

FIG. 5 is a Cordier's diagram showing a relationship between a specific diameter and a specific speed.

Referring to FIG. 5, the impeller 20 according to the present disclosure has a specific diameter ($D_s$) value and a specific speed ($N_s$) value, which are dimensionless values. These are defined by Mathematical Equations as follows:

$$N_s = \frac{\Phi^{\frac{1}{2}}}{\Psi^{\frac{3}{4}}} \quad \text{[Mathematical Equation 1]}$$

$$D_s = \frac{\Psi^{\frac{1}{4}}}{\Phi^{\frac{1}{2}}} \quad \text{[Mathematical Equation 2]}$$

where φ means a flow coefficient, and ψ means a head coefficient. These are respectively represented by Mathematical Equations as follows:

$$\Phi = \frac{Q}{ND^3} \quad \text{[Mathematical Equation 3]}$$

$$\Psi = \frac{\Delta P_T}{\rho N^2 D^2} \quad \text{[Mathematical Equation 4]}$$

where ρ means a coefficient, Q means a flow rate, N means a speed (rpm), D means a diameter, and PT is a head of a pump.

Sirroco_AC and Sirroco_DC of a sirrocco fan, i.e., specific diameter values and specific speed values are distributed at a lower end of the Cordier's diagram. Here, it can be confirmed that specific diameter values and specific speed values of the present disclosure deviate from the distribution of Sirroco_AC and Sirroco_DC of the sirrocco fan, i.e., the specific diameter values and the specific speed values.

Figure 6:
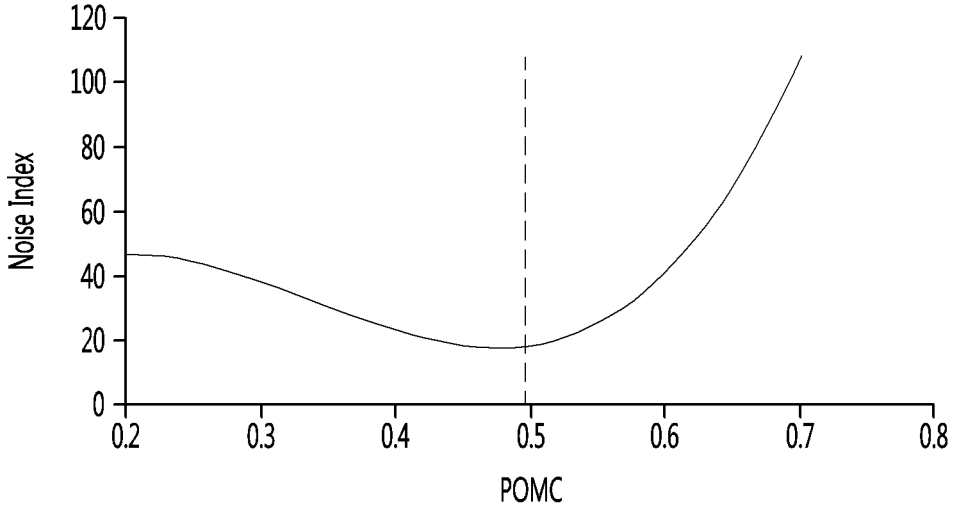
FIG. 6 is a graph showing a relationship between a position of maximum camber (POMC) and a noise of a centrifugal fan.

FIG. 6 is a graph showing a relationship between a POMC and a noise of a centrifugal fan.

Referring to FIG. 6, it can be seen that when a POMC value of the blade 201 is about 0.5, a noise becomes minimum, and when the POMC value of the blade 201 exceeds about 0.5, a noise is rapidly increased.

In addition, it can be seen that as the POMC value of the blade 201 becomes smaller than about 0.5, a noise is gradually increased.

It is preferable that the POMC value of the blade 201 is in a range of about 0.01 to about 0.49.

Figures 7, 8:
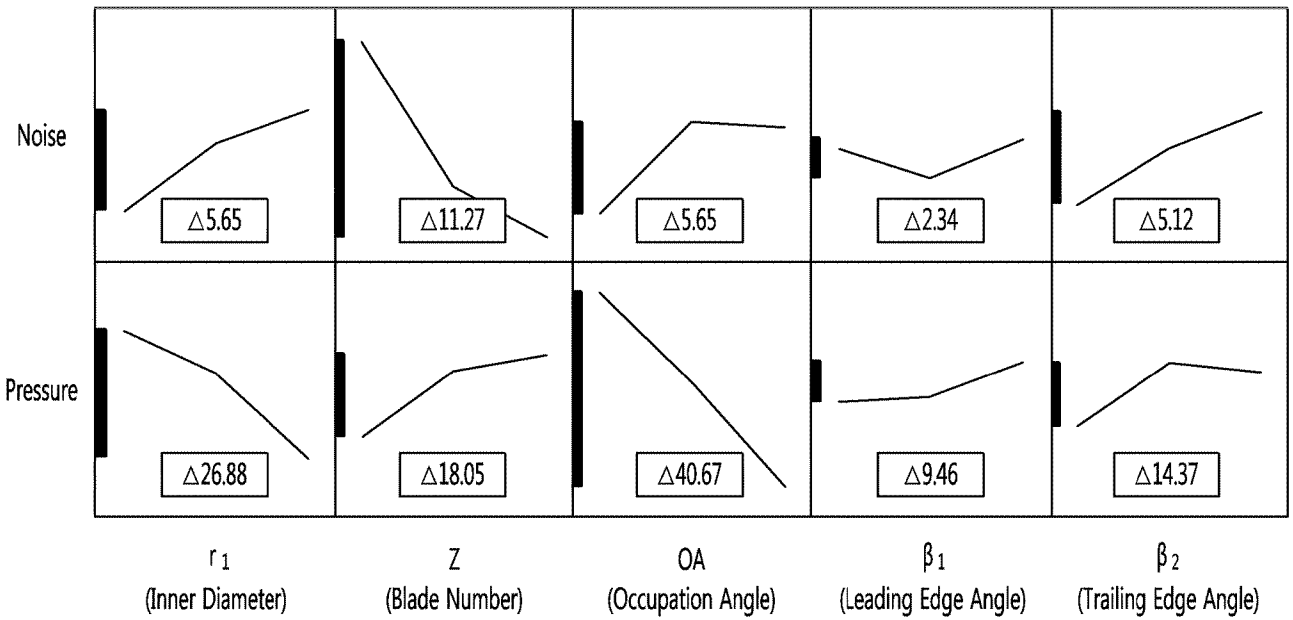
FIG. 7 is a table showing a design requirement when an impeller satisfies a condition of FIG. 6.
FIG. 8 is a graph showing a noise and pressure performance according to a design requirement of a blade in a centrifugal fan according to an embodiment of the present disclosure.

FIG. 7 is a table showing a design requirement when the impeller satisfies the condition of FIG. 6.

Design factors shown in the table will be described below with reference to FIG. 7.

D2/H is a diameter/height ratio and is defined as a value obtained by dividing an external diameter of the blade 201 by a height (H) of the impeller 20. N (rpm) means a rotational speed of the impeller 20. Z (ea.) means the number of the blades 201 provided in the impeller 20.

Meanwhile, as a $\beta_2$ value of the blade 201 is increased, efficiency of the impeller 20 is increased and a flow noise is reduced.

FIG. 8 is a graph showing a noise and pressure performance according to a design requirement of a blade in a centrifugal fan according to an embodiment of the present disclosure.

Referring to FIG. 8, it can be seen that an influence of $r_1$, Z, and OA is large with respect to the pressure performance, and an influence of $r_1$, Z, and $\beta_2$ is small with respect to a noise factor.

In addition, it can be seen that $r_1$ is inversely proportional to Z and is proportional to OA.

As described above, when the impeller 20 of the centrifugal fan 1 is designed to satisfy the specific speed $N_s$ value and the specific diameter $D_s$ value proposed in the present disclosure, it is possible to satisfy a flow rate and pressure performance and also reduce a flow noise.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A centrifugal fan comprising:

a housing;

an impeller mounted inside the housing;

a hub provided inside the impeller, the hub being rotated by a driving force of a motor; and a plurality of blades attached to the hub, each of the blades radially extending from the hub and having a leading edge and a trailing edge;

wherein each of the plurality of blades has a curved shape from the leading edge to the trailing edge in a rotational direction of the impeller, wherein a peak point of each of the plurality of blades is located closer to the leading edge than the trailing edge, whereby the peak point is a point that is farthest from a plane connecting the leading edge and the trailing edge, and wherein to increase efficiency of the impeller and reduce a flow noise, for each of the plurality of blades, an exit angle of air at the trailing edge is greater than or equal to 49.95° and less than or equal to 63.85°.

2. The centrifugal fan of claim 1, wherein a ratio of a distance from the leading edge to the peak portion to a distance from the leading edge to the trailing edge is defined as a position of maximum camber (POMC) value, the POMC value being greater than or equal to 0.01 and less than or equal to 0.49.

3. The centrifugal fan of claim 1, wherein a ratio of a height of the peak portion to a distance from the leading edge to the trailing edge is defined as a maximum camber (MC) value, the MC value being greater than or equal to 0.05 and less than or equal to 0.16.

4. The centrifugal fan of claim 1, wherein an entrance angle of air at the leading edge is greater than or equal to 90.74° and less than or equal to 104.35°.

5. The centrifugal fan of claim 1, wherein an angle formed by the leading edge and the trailing edge is greater than or equal to 5.5° and less than or equal to 9.8° with respect to a rotational center of the impeller.

6. The centrifugal fan of claim 1, wherein the number of the plurality of blades mounted in the impeller is greater than or equal to 50 blades and less than or equal to 60 blades.

7. The centrifugal fan of claim 1, wherein a diameter of a circle connecting the leading edges respectively provided in the plurality of blades is greater than or equal to 116.4 mm and less than or equal to 128.8 mm.

8. The centrifugal fan of claim 2, wherein when the POMC value is greater than or equal to 0.40 and less than or equal to 0.49.

9. The centrifugal fan of claim 1, wherein the impeller generates air flow through the housing.

10. The centrifugal fan of claim 1, wherein the peak point is located at a position closer to a rotational axis of the impeller than a central portion of each of the blades.

11. The centrifugal fan of claim 1, wherein the housing comprises a suction port through which air is suctioned by rotation of the impeller and a discharge port through which air is discharged by rotation of the impeller.

12. The centrifugal fan of claim 1, wherein a cut-off portion is formed at one side of the discharge port.

13. The centrifugal fan of claim 12, wherein a cross-sectional area of an air channel for air flowing in the housing gradually increases from the cut-off portion to the discharge port in an air flow direction.

* * * * *